US006450137B2

(12) United States Patent
Ogawa

(10) Patent No.: US 6,450,137 B2
(45) Date of Patent: Sep. 17, 2002

(54) VARIABLE VALVE TIMING SYSTEM

(75) Inventor: Kazumi Ogawa, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/745,737

(22) Filed: Dec. 26, 2000

(30) Foreign Application Priority Data

Dec. 24, 1999 (JP) ..... 11-365755

(51) Int. Cl.[7] ..... F01L 1/344
(52) U.S. Cl. ..... 123/90.17
(58) Field of Search ..... 123/90.15, 90.17, 123/90.31; 74/568 R; 464/1, 2, 160

(56) References Cited

U.S. PATENT DOCUMENTS 6,053,139 A * 4/2000 Eguchi et al. ..... 123/90.17
6,058,897 A * 5/2000 Nakayoshi ..... 123/90.17
6,062,182 A * 5/2000 Ogawa ..... 123/90.17
6,302,072 B1 * 10/2001 Sekiya et al. ..... 123/90.17

FOREIGN PATENT DOCUMENTS

JP 1-92504 4/1989
JP 9-250310 9/1997
JP 9-324613 12/1997

* cited by examiner

*Primary Examiner*—Weilun Lo
(74) *Attorney, Agent, or Firm*—Burns, Doane, Swecker & Mathis, LLP

(57) ABSTRACT

A variable valve timing system that inhibits or substantially prevents the generation of noise produced by the vane at engine start, improves smooth engine start and enlarges the variable timing control area includes a first relative rotation restricting member restricting relative rotation between a rotation member and a rotation transmitting member from the most advanced angle position to the most retarded angle position at a position corresponding to engine start and a second rotation restricting member restricting relative rotation between the rotation member and the rotation transmitting member from the most retarded angle position to the most advanced angle position at the position corresponding to the engine start and releasing the restriction by fluid pressure in the advanced angle chamber.

14 Claims, 9 Drawing Sheets

VARIABLE VALVE TIMING SYSTEM

This application is based on and claims priority under 35 U.S.C. §119 with respect to Japanese Application No. 11-365755 filed on Dec. 24, 1999, the entire content of which is incorporated herein by reference.

FIELD OF THE INVENTION

This invention generally relates to vehicle engines. More particularly, the present invention pertains to a variable valve timing system for controlling the opening and closing timing of an intake valve and an exhaust valve of a vehicle engine while the engine is actuated or operating.

BACKGROUND OF THE INVENTION

Known variable valve timing systems are described in Japanese Patent Laid-Open Publication H01-92504 and Japanese Patent Laid-Open Publication H09-250310. The disclosed variable valve timing systems include a rotation transmitting member rotatably supported in a predetermined range relative to a rotation member rotating with a cam shaft. The rotation transmitting member transmits a rotation force from a crank sprocket or a pulley of a crankshaft, and is provided with a recessed portion at its inner peripheral portion. The variable valve timing system also includes a plurality of vanes provided on the rotation member, a fluid pressure chamber formed between the recess portion and the rotation member and divided into an advanced angle chamber and a retarded angle chamber by the vane, a first fluid conduit supplying fluid to and discharging the fluid from the advanced angle chamber, a second fluid conduit supplying fluid to and discharging the fluid from the retarded angle chamber, and a relative phase restricting mechanism restricting a relative phase between the rotation member and the rotation transmitting member when the relative phase between the rotation member and the rotation transmitting member corresponds to the predetermined phase.

In the variable valve timing system disclosed in the publications mentioned above, the rotation member is rotated relative to the rotation transmitting member to move the vanes in the advanced angle direction of the recess portion to a certain position until reaching the most advanced angle position to advance the angle of the valve opening and closing timing by supplying the operation fluid to the advanced angle chamber via the first fluid conduit and discharging the operation fluid from the retarded angle chamber via the second fluid conduit. The rotation member is rotated relative to the rotation transmitting member to move the vane of the recess portion in the retarded angle direction to a certain position until reaching the most retarded angle position to retard the angle of the valve opening and closing timing by supplying operation fluid to the retarded angle chamber via the second fluid conduit and by discharging the operation fluid from the advanced angle chamber via the first fluid conduit.

With further regard to the variable valve timing system disclosed in the publications mentioned above, the rotation member is always affected by the force in the retarded angle direction by a variable torque affecting the cam shaft during the engine operation. When the supply of operation fluid to the fluid pressure chamber stops as the engine stops, the vane is not able to be locked by the fluid pressure of the fluid pressure chamber, the rotation member is rotated in the retarded angle direction relative to the rotation transmitting member (until the crankshaft is completely stopped) to stop the rotation member and the rotation transmitting member at the relative phase in accordance with the relative phase therebetween immediately before the engine stops. When the engine is started in this condition, the rotation member is rotated in the retarded angle direction relative to the rotation transmitting member by the fluid pressure in the retarded angle direction and the vane reaches the phase at the most retarded angle position where the vane contacts the peripheral direction end surface of the advanced angle side of the recess portion. When the engine is started in this condition, the vane stays unstable until the fluid pressure in the fluid pressure chamber is increased to lock the vane, and the vane is vibrated by the variable torque affecting the cam shaft to contact a peripheral end surface of the recess portion and thus generates noise. To avoid this drawback, the relative phase between the rotation member and the rotation transmitting member is restricted at the most retarded angle position by the relative phase restricting mechanism.

In general, the volumetric efficiency is improved by delaying the closing timing of the intake valve to improve the output of the engine because the intake air enters the cylinder by inertia even after the piston starts to move towards the top dead center at the high speed velocity area of the engine.

However, in the case of the variable valve timing systems disclosed in the aforementioned publications for controlling the opening and closing timing of the intake valve, because the valve timing for opening and closing at the most retarded angle position is required to be determined at the time when the air can be taken in at the start of the engine, it is difficult to improve the volumetric efficiency by retarding the closing timing of the intake valve to utilize the inertia of the intake air at the high speed velocity area. When the valve opening and closing timing at the most retarded angle position is determined at the time capable of improving the volumetric efficiency by the inertia of the intake air, the intake valve is opened even after the piston passes the bottom dead center position and moves towards the top dead center position at the engine start at the most retarded angle position. Moreover, because the intake air is not accompanied by inertia, once sucked or drawn-in intake air is reversely moved to be discharged not to raise the compression ratio to generate the condition which cannot achieve the combustion. This may cause difficulty with respect to the engine start. This problem tends to be generated at the place with low pressure when the closing timing of the intake valve is determined after the piston passes the bottom dead center position even when the valve opening and closing timing at the most retarded angle position is determined at the time capable of taking in the air at the engine start and even when the valve opening and closing timing at the most retarded angle position is not determined at the time capable of improving the volumetric efficiency by the inertia of the intake air.

When the variable valve timing system in the aforementioned publications is used for controlling the opening and closing of the exhaust valve, the retarded closing timing of the exhaust valve elongates or extends the overlapping period of the intake valve and the exhaust valve, thus deteriorating the engine start by increasing the internal EGR volume (exhaust gas re-circulation volume).

To address the aforementioned problems, Japanese Patent Laid-Open Publication H09-324613 describes a system in which the relative phase between the rotation member and the rotation transmitting member is restricted by the relative phase restricting mechanism at a middle position moved to the advanced angle by a predetermined angle compared to the most retarded angle position in accordance with the valve opening and closing timing capable of improving the volumetric efficiency by the inertia of the intake air. However, in this system, it is only for a brief moment that the relative phase of the rotation member and the rotation transmitting member is positioned at the predetermined middle position when the rotation member rotates in the retarded angle direction relative to the rotation transmitting member at the engine stop. Accordingly, the relative phase between the rotation member and the rotation transmitting member cannot be completely restricted at the predetermined middle position by the relative phase restricting mechanism and noise may be generated by contact between the vane and the peripheral end surface of the recess portion of the rotation transmitting member at the engine start, and so smooth start of the engine cannot be achieved.

In light of the foregoing, a need exists for a variable valve timing system which can improve smooth engine start while also preventing noise generation by the vane during engine start.

A need also exists for a variable valve timing system that is capable of enlarging the variable timing control area.

SUMMARY OF THE INVENTION

In light of the foregoing, the present invention provides a variable valve timing system that includes a rotation member rotating with one of a crankshaft and a cam shaft, a rotation transmitting member rotatably supported on the rotation member relative to the rotation member within a predetermined range and rotating with the other of the crankshaft and the cam shaft, a vane provided on the rotation member, and a fluid pressure chamber formed between the rotation member and the rotation transmitting member and divided into an advanced angle chamber and a retarded angle chamber by the vane. The rotation member and the rotation transmitting member are relatively rotated by the fluid pressure applied to the advanced angle chamber and the retarded angle chamber, and the opening and closing timing of the valve actuated by the camshaft is varied by changing the rotation phase of the cam shaft relative to the rotation phase of the crankshaft. The variable valve timing system also includes a first relative rotation restricting mechanism that restricts relative rotation between the rotation member and the rotation transmitting member from the most advanced angle position where the volume of the retarded angle chamber is the minimum to the most retarded angle position where the volume of the advanced angle chamber is the minimum at the position corresponding to the engine start at which the vane is positioned approximately in the middle of the fluid pressure chamber and releases the restriction by the fluid pressure towards the retarded angle chamber. A second relative rotation restricting mechanism restricts the relative rotation of the rotation member and the rotation transmitting member from the most retarded angle position to the most advanced angle position at the position corresponding to the engine start and releases the restriction by fluid pressure towards the advanced angle chamber.

Although the vane cannot be locked by the fluid pressure of the fluid pressure chamber to rotate the rotation member in the retarded direction relative to the rotation transmitting member when the supply of operation fluid to the fluid pressure chamber is stopped at the engine stop, the relative phase between the rotation member and the rotation transmitting member is locked at the position corresponding to the engine start, where the vane is positioned approximately in the middle of the fluid pressure chamber by the first relative rotation restricting mechanism and the second relative rotation restricting mechanism at the engine start. Consequently, the noise which might otherwise be generated by the contact between the vane and the peripheral end surface of the fluid pressure chamber at the engine start can be inhibited or substantially prevented.

Because the valve opening and closing timing at the engine start is obtained at the relative phase of the rotation member and the rotation transmitting member when the vane is positioned at the engine start position, at the most retarded angle position the opening and closing timing of the vane can be further retarded compared to the relative phase at the position corresponding to the engine start. Accordingly, an improvement in the volumetric efficiency can be realized by utilizing the inertia of the intake air, and the valve opening and closing timing at the engine start can be advanced to achieve smooth starting of the engine by not generating compression ratio deterioration.

The first relative rotation restricting mechanism may include a first restricting member biased by a spring and accommodated in either one of the rotation member and the rotation transmitting member, and a first restricting groove formed either on the rotation member or the rotation transmitting member to allow relative rotation between the rotation member and the rotation transmitting member from the position corresponding to the engine start to the most advanced angle position by the positioning the first restricting member in the first restricting groove, and to restrict relative rotation from the position corresponding to the engine start to the most retarded angle position. The second relative rotation restricting mechanism may include a second restricting member biased by spring and accommodated in either the rotation member or the rotation transmitting member and a second restricting groove formed either on the rotation member or the rotation transmitting member to restrict the relative rotation of the rotation member and the rotation restricting member from the position corresponding to the engine start to the most advanced angle position by positioning of the second restricting member in the second restricting groove, and to allow relative rotation from the position corresponding to the engine start to the most retarded angle position.

In the variable valve timing system of the present invention, a biasing member is provided to apply a predetermined biasing force that always biases the rotation member towards the advanced angle side relative to the rotation transmitting member.

According to another aspect of the invention, a variable valve timing system for an internal combustion engine includes a rotation member rotating with either a crankshaft or a cam shaft, a rotation transmitting member rotatably supported relative to the rotation member within a predetermined range and rotating with the other of the crankshaft and the cam shaft, a vane provided on the rotation member, and a fluid pressure chamber formed between the rotation member and the rotation transmitting member and divided by the vane into an advanced angle chamber and a retarded angle chamber. The rotation member and the rotation transmitting member are relatively rotated by fluid pressure in the advanced angle chamber and the retarded angle chamber, with a rotation phase of the cam shaft changing relative to the rotation phase of the crankshaft to change opening and closing timing of a valve. A first relative rotation restricting member restricts relative rotation between the rotation member and the rotation transmitting member from a most advanced angle position in which the volume of the retarded angle chamber is a minimum to a most retarded angle position in which the volume of the advanced angle chamber is a minimum at a position corresponding to the engine start at which the vane is positioned at approximately a middle of the fluid pressure chamber and releasing a first restriction by the fluid pressure greater than a first predetermined pressure after the engine start. A second relative rotation restricting member restricts relative rotation between the rotation member and the rotation transmitting member from the most retarded angle position to the most advanced angle position and releases a second restriction by the fluid pressure at greater than a second predetermined pressure after the engine start.

Another aspect of the invention involves a variable valve timing system for an internal combustion engine that includes a rotation member adapted to rotate together with either a crankshaft or a cam shaft, a rotation transmitting member supported with respect to the rotation member for relative rotation between the rotation member and the rotation transmitting member within a predetermined range, a vane provided on the rotation member, and a fluid pressure chamber formed between the rotation member and the rotation transmitting member and divided by the vane into an advanced angle chamber and a retarded angle chamber. The rotation member and the rotation transmitting member are relatively rotated by fluid pressure applied to the advanced angle chamber and the retarded angle chamber to change the opening and closing timing of a valve to be actuated by the cam shaft by changing the rotation phase of the cam shaft relative to the rotation phase of the crankshaft. The system also includes a first bore provided in either the rotation member or the rotation transmitting member, a first groove provided in the other of the rotation member and the rotation transmitting member, and a first pin slidably received in the first bore for sliding movement between one position in which a portion of the first pin is received in the first groove to restrict relative rotation between the rotation member and the rotation transmitting member to an engine start position at which the vane is positioned at approximately a middle of the fluid pressure chamber and a second position at which the portion of the first pin is moved out of the first groove by fluid pressure to restrict relative rotation between the rotation member and the rotation transmitting member from a most advanced angle position in which a volume of the retarded angle chamber is a minimum to the engine start position.

BRIEF DESCRIPTION OF THE DRAWING FIGURES

The foregoing and additional features and characteristics of the present invention will become more apparent from the following detailed description considered with reference to the accompanying drawing figures in which like elements or features are designated by like reference numerals and wherein.

DETAILED DESCRIPTION OF THE INVENTION

Figure 1:
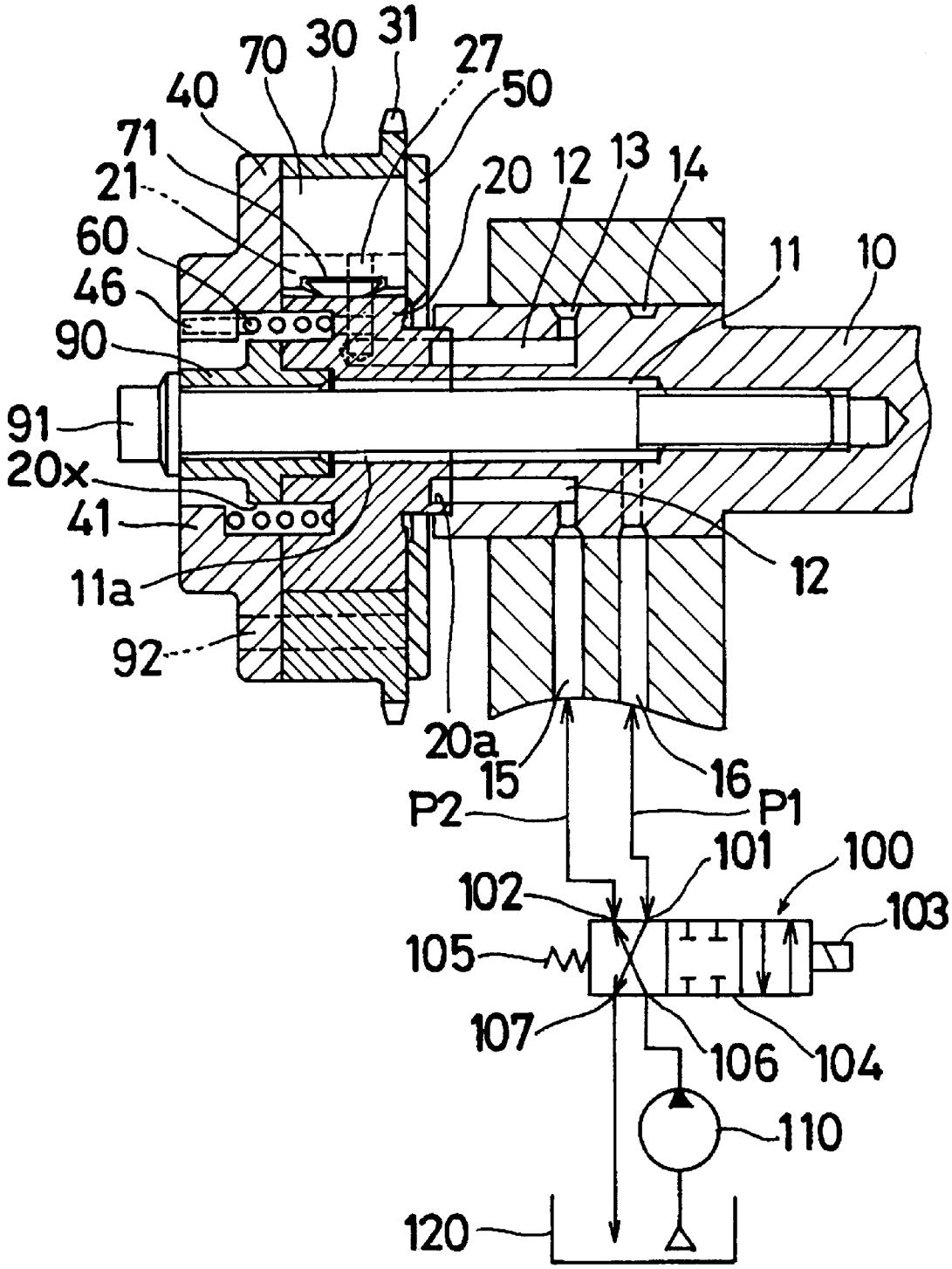
FIG. 1 is longitudinal cross-sectional side view of a variable valve timing system according to the present invention.

An embodiment of a variable valve timing system for an internal combustion engine in accordance with the present invention is described below with reference to FIGS. 1–16. Referring initially to FIGS. 1–4, the variable valve timing system includes a rotation member including an inner rotor 20 assembled as one unit with a tip portion (i.e., left end portion in FIG. 1) of a cam shaft 10 that is rotatably supported by the cylinder head of an internal combustion engine, a rotation transmitting member including an outer rotor 30 supported to the cam shaft 10 and the inner rotor 20 in a rotatable manner over a predetermined range, a front plate 40, a rear plate 50, and a timing sprocket 31 formed as one unit or integrally on the outer periphery of the outer rotor 30, a first relative rotation restricting mechanism including a first lock pin 82 assembled to the front plate 40, a second relative rotation restricting mechanism including a second lock pin 80 assembled to the front plate 40, and a torsion spring 60 (i.e., a biasing member) provided between the rotation member 20 and the rotation transmitting member 30 to bias the rotation member to the advanced angle side (i.e., the direction that enlarges an advanced angle chamber) relative to the rotation transmitting member. The timing sprocket 31 is structured to transmit the rotation force in the clockwise direction in FIG. 2 via a crankshaft, a crank sprocket, and a timing chain (not shown).

The cam shaft 10, which includes a well known cam (not shown) opening and closing an intake valve (not shown), is provided with an advanced angle conduit 11 extending in the axial direction of the cam shaft 10 and a retarded angle conduit 12. The advanced angle conduit 11 is formed in an installation bore on the cam shaft 10 that receives an installation bolt 91. The advanced angle conduit 11 is connected to a connecting port 101 of a control valve 100 via a radially extending conduit of the cam shaft 10, a second annular groove 14 of the cam shaft 10 and a second connecting conduit 16 provided on the cylinder head. The retarded angle conduit 12 is connected to a connecting port 102 of the control valve 100 via another radially extending conduit provided on the cam shaft 10, a first annular groove 13 of the cam shaft 10 and a first connecting conduit 15 provided on the cylinder head.

A spool 104 is disposed in a housing of the control valve 100 and is axially movable in the left direction as viewed in FIG. 1 against the biasing force of a spring 105 by energization of a solenoid 103. A supply port 106 connected to an oil pump 110 actuated by the engine communicates with a second connecting port 102, and a first connecting port 101 communicates with a discharge port 107 when the solenoid 103 is de-energized. When the solenoid 103 is energized, the supply port 106 communicates with the connecting port 101 and the connecting port 102 communicates with the discharge port 107. Accordingly, the operation fluid is supplied to the retard conduit 12 when the solenoid 103 of the control valve 100 is de-energized, while the operation fluid is supplied to the advance conduit 11 when the solenoid 103 is energized. Energization of the solenoid 103 is duty-controlled by a control device (not shown).

The inner rotor 20 connected to the cam shaft 10 as one unit via a spacer 90 with the installation bolt 91 includes vane grooves 21 providing four vanes 70 that are movable in the radial direction, a first conduit 24 in communication with an advanced angle chamber R1 (except the one on the top left of FIG. 2) divided by each vane 70 via a conduit 11*a* formed between the inner bore of the inner rotor 20 and the outer surface of the bolt 91, a third annular groove 20*a* formed on an end face of the inner rotor 20 opposite to the tip surface of the cam shaft 10 and in communication with the retard conduit 12, four second conduits 25 extending from the annular groove 20*a* towards the other end surface side in the axial direction, third conduits 27 establishing communication between each second conduit 25 and each retarded angle chamber R2 (except the left bottom one in FIG. 2) to supply and discharge operation fluid from the retarded angle conduit 12 to the retarded angle chamber R2 divided by each vane 70 via the third annular groove 20*a* and the second conduits 25. Each vane 70 is biased in the radially outward direction by a vane spring 71 accommodated at the bottom of the vane groove 21.

One end surface (i.e., the left side in FIG. 2) of the inner rotor 20 is provided with a second restricting groove 23*c* (shown in FIG. 3) extending in the peripheral direction to insert a predetermined portion of the head of a second lock pin 80 when the relative phase between the inner rotor 20 and the outer rotor 30 is within the range of the relative phase corresponding to a start of the engine and the relative phase corresponding to the most advanced angle position (where the vane 70 contacts a retarded angle side peripheral direction end surface of the projection 32 and the volume of the retarded angle chamber is at a minimum). In addition, a first restricting groove 26*c* (shown in FIG. 7) extending in the peripheral direction is provided to receive a predetermined proportion of the head of a first lock pin 82 when the relative phase of the inner rotor 20 and the outer rotor 30 is within the range of the relative phase corresponding to the start of the engine and the relative phase corresponding to the most retarded angle position (where the vane 70 contacts an advance angle side peripheral direction end surface of the projection 32 and the volume of the advanced angle chamber is at a minimum). The end portion of the second restricting groove 23*c* of the advanced angle side of the inner rotor 20 opens to the outer peripheral surface of the inner rotor 20. An end portion of the first restricting groove 26*c* of the retarded angle side (i.e., the direction enlarging the retarded angle chamber) of the inner rotor opens to the outer peripheral surface of the inner rotor 20.

Figure 2:
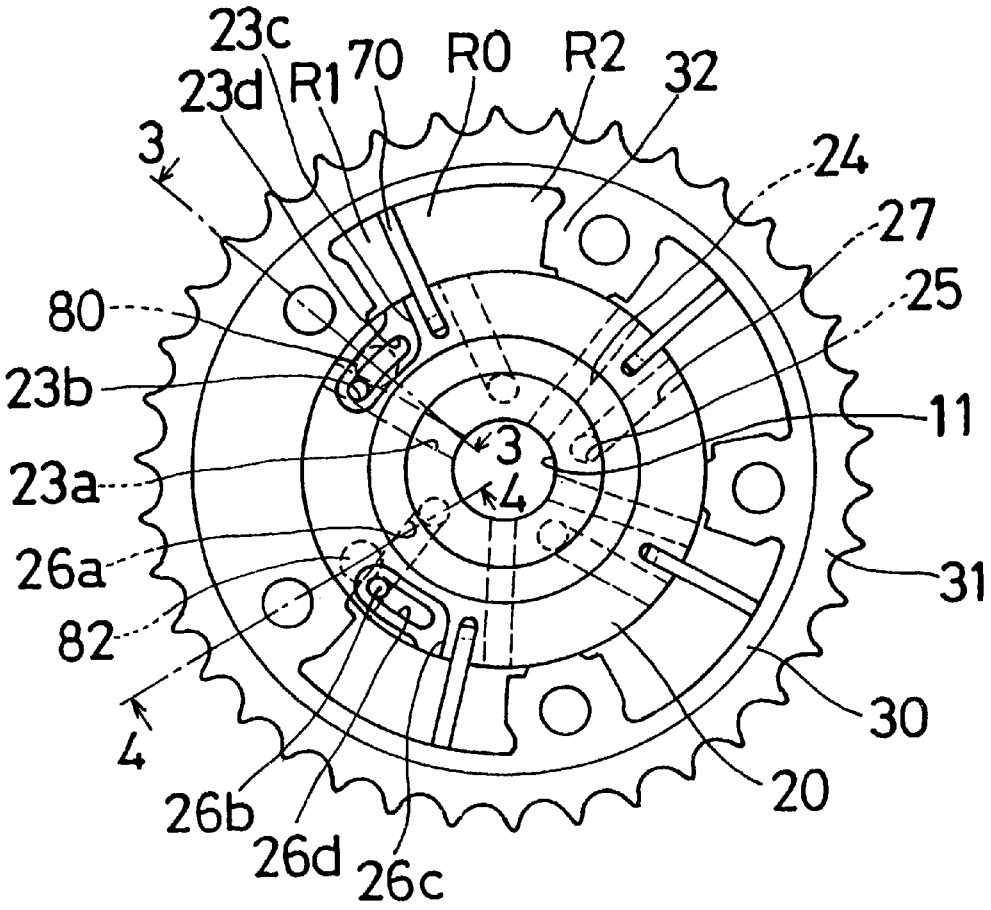
FIG. 2 is a front view of the variable valve timing system shown in FIG. 1 with a front plate removed and in a condition in which the engine is stopped at a further retarded angle side as compared to the lock position shown in FIG. 1.

The inner rotor 20 also includes a fourth conduit 23*a* extending radially outwardly from the conduit 11*a* formed between the inner bore of the inner rotor 20 and the bolt 91 and opening to the outer peripheral surface of the rotor 20, a fifth conduit 23*b* establishing communication between the fourth conduit 23*a* and the second restricting groove 23*c*, a sixth conduit 26*a* extending radially outwardly from the second conduit 25 at the left bottom of FIG. 2 and opening to the outer peripheral surface of the inner rotor 20, and a seventh conduit 26*b* establishing the communication between the sixth conduit 26*a* and the first restricting groove 26*c*. The fifth conduit 23*b* opens to the bottom end portion of the second restricting groove 23*c* on the retarded angle side of the inner rotor 20. The seventh conduit 26*b* opens to the bottom end portion of the first restricting groove 26*c* on the advanced angle side of the inner rotor 20. A first groove 23*d* extending in peripheral direction and in communication with the fifth conduit 23*b* at the retarded angle side of the inner rotor 20 is formed at the bottom of the second restricting groove 23*c*. A second groove 26*d* extending in the peripheral direction and in communication with the seventh conduit 26*b* at the advanced angle side of the inner rotor 20 is formed at the bottom of the first restricting groove 26*c*.

The outer rotor 30 assembled on the outer periphery of the inner rotor 20 for relative rotation over the predetermined range is provided with the front plate 40 and the rear plate 50 on opposite sides. The front plate 40 and the rear plate 50 are connected to the outer rotor 30 by a plurality (e.g., five) connecting bolts 92 so that the outer rotor 30, the front plate 40 and the rear plate 50 form a unit. Four projection portions 32 projecting in the radially inward direction are formed on the inner periphery of the outer rotor 30 at a predetermined interval in the peripheral direction. The outer rotor 30 is rotatably supported by the inner rotor 20 so that the inner peripheral surface of the projection portions 32 slidably contact the outer peripheral surface of the inner rotor 20.

The front plate 40 includes an axially extending second retracting bore 42 accommodating the second lock pin 80 and a second spring 81, and an axially extending first retracting bore 43 accommodating the first lock pin 82 and the first spring 83 formed in axial direction of the outer rotor 30. The second retracting bore 42 is positioned opposite to the second restricting groove 23*c* of the inner rotor 20 when the relative phase of the inner rotor 20 and the outer rotor 30 is within the range of the relative phase corresponding to the start of the engine and the relative phase corresponding to the most retarded angle position. The first retracting bore 43 is positioned opposite to the first restricting groove 26*c* of the inner rotor 20 when the relative phase of the inner rotor 20 and the outer rotor 30 is within the range of the relative phase corresponding to the start of the engine and the relative phase corresponding to the most advanced angle position.

Each vane 70 includes a tip end having an arc-shaped cross-section and is assembled to the vane groove 21 of the inner rotor 20 between the front plate 40 and the rear plate 50 for movement in the radial direction. A plurality of fluid pressure chambers R0 are provided, each defined between the outer rotor 30, a pair of adjacent projection portions 32 of the outer rotor 30, the inner rotor 20, the front plate 40 and the rear plate 50. Each vane 70 divides one of the fluid pressure chambers R0 into the advanced angle chamber R1 and the retarded angle chamber R2, and restricts the phase (the predetermined relative rotation range of the inner rotor 20 and the outer rotor 30) adjusted by the variable valve timing system when the vane 70 contacts the peripheral end surface of the projection 32 formed on the outer rotor 30. Accordingly, relative rotation to the advanced angle side of the inner rotor 20 relative to the outer rotor 30 is restricted when the vane 70 at the bottom left of FIG. 11 contacts the peripheral end surface of the retarded angle side of the projection portion 32 (i.e., the most advanced angle position). The relative rotation to the retarded angle side of the inner rotor 20 relative to the outer rotor 30 is restricted when the vane 70 at the top left of FIG. 14 contacts the peripheral end surface of the advance side of the projection 32 (i.e., the most retarded angle position).

Figure 3:
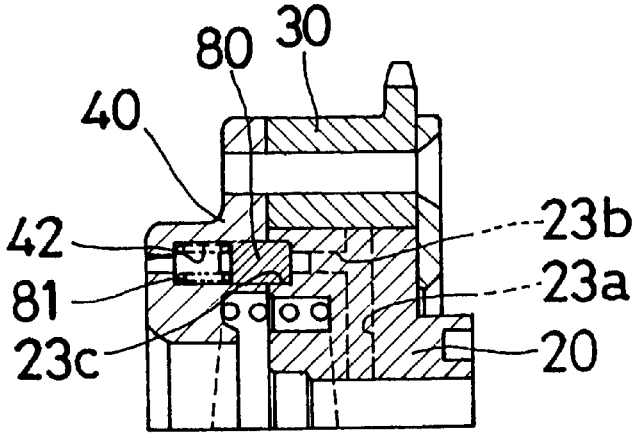
FIG. 3 is a cross-sectional view taken along the section line 3—3 of FIG. 2.
Figure 4:
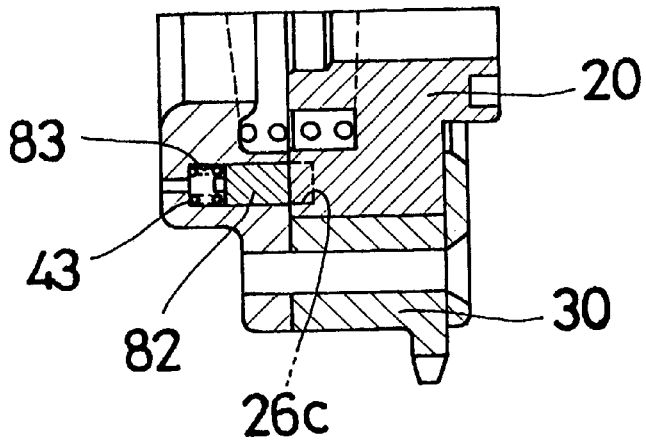
FIG. 4 is a cross-sectional view taken along the section line 4—4 of FIG. 2.

The second lock pin 80 assembled in the second retracting bore 42 for slidable movement in the axial direction is biased towards the right as viewed in FIG. 3 by the second spring 81 provided between the second lock pin 80 and the bottom of the second retracting bore 42. The first lock pin 82 assembled in the first retracting bore 43 for slidable movement in the axial direction is biased towards the right as viewed in FIG. 4 by the first spring 83 provided between the first lock pin 82 and the bottom of the first retracting bore 43. Accordingly, when the relative phase of the inner rotor 20 and the outer rotor 30 is within the range of the relative phase corresponding to the start of the engine and the relative phase corresponding to the most retarded angle position, the head portion of the second lock pin 80 is positioned in the second restricting groove 23*c*, relative rotation of the inner rotor 20 and the outer rotor 30 from the position corresponding to the start of the engine to the position corresponding to the most retarded angle position is allowed, and relative rotation of the inner rotor 20 and the outer rotor 30 from the position corresponding to the start of the engine to the most advanced angle position is restricted. When the relative phase of the inner rotor 20 and the outer rotor 30 is within the range of the relative phase corresponding to the start of the engine and the relative position corresponding to the most advanced angle position, the head of the first lock pin 82 is positioned in the first restricting groove 26*c*, relative rotation of the inner rotor 20 and the outer rotor 30 from the position corresponding to the start of the engine to the most advanced angle position is allowed, and relative rotation of the inner rotor 20 and the outer rotor 30 from the position corresponding to the start of the engine to the most retarded angel position is restricted.

When the relative phase of the inner rotor 20 and the outer rotor 30 is at the relative phase corresponding to the start of the engine, the second lock pin 80 is inserted into or positioned in the second restricting groove 23*c* and the first lock pin 82 is inserted into or positioned in the first restricting groove 26*c* to lock or fix the relative phase position of the inner rotor 20 and the outer rotor 30.

In accordance with this version of the variable valve timing system of the present invention, the rotation member comprised of the inner rotor 20 is always biased in the advanced angle direction relative to the rotation transmitting member comprised of the outer rotor 30, the front plate 40, and the rear plate 50 by the torsion spring 60. The biasing force of the torsion spring 60 is predetermined to correspond to the average value of the variable torque (the average torque for rotating the cam shaft 10 to the retarded angle side) affecting or acting on the cam shaft 10. The torsion spring 60 is accommodated in a cylindrical portion 41 of the front plate 40 and a fourth annular groove 20*x* formed on the front side of the inner rotor 20 continuously with respect to the cylindrical portion 41. One end of the torsion spring 60 is engaged with a flange portion 46 formed on the end portion of the cylindrical portion 41 and the other end of the spring 60 is engaged with the bottom portion of the fourth annular groove 20*x*.

In accordance with this version of the variable valve timing system of the present invention, when the relative phase of the inner rotor 20 and the outer rotor 30 is at a relative phase corresponding to the start of the engine, the opening and closing timing of the intake valve is predetermined to correspond to the timing when the engine start is available. When the relative phase corresponds to the engine start, each vane 70 is positioned approximately in the middle of the fluid pressure chamber R0 as shown in FIG. 8, wherein the inner rotor 20 is rotated relative to the outer rotor 30 from the most retarded angle position (shown in FIG. 14) towards the advanced angle side by a predetermined angle θ.

Figure 8:
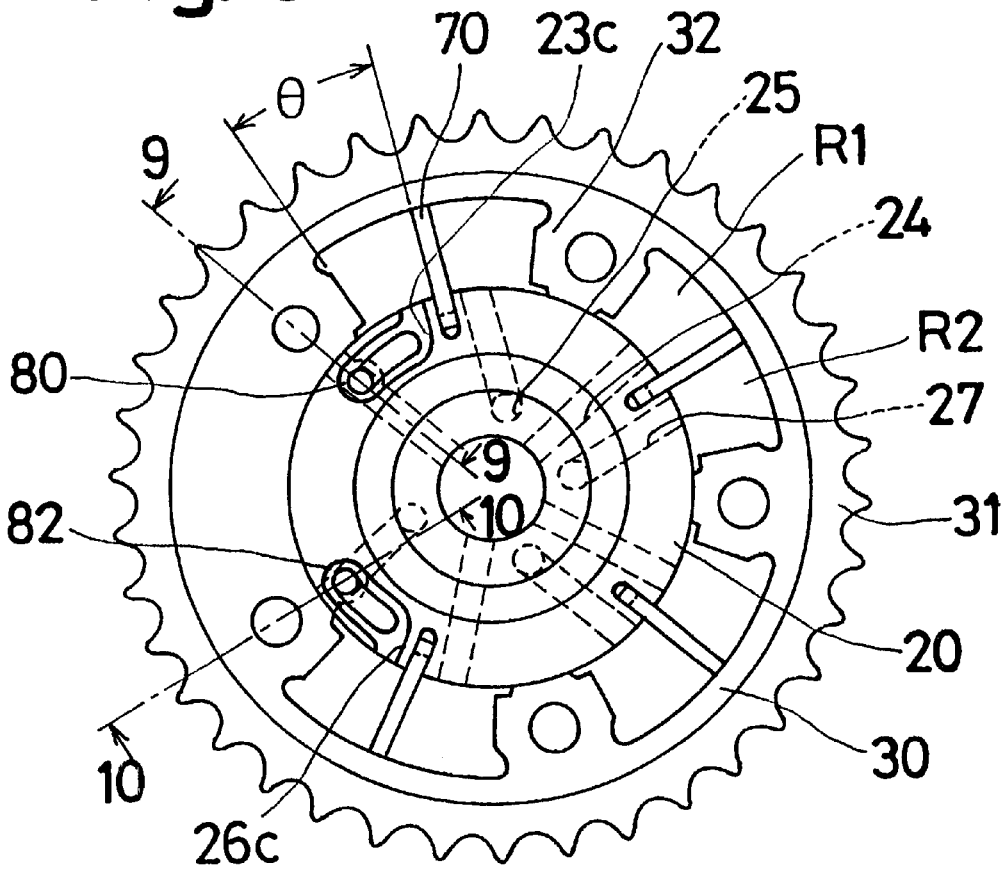
FIG. 8 is a front view illustrating the lock condition of the variable valve timing system shown in FIG. 1, with the front plate removed.
Figure 9:
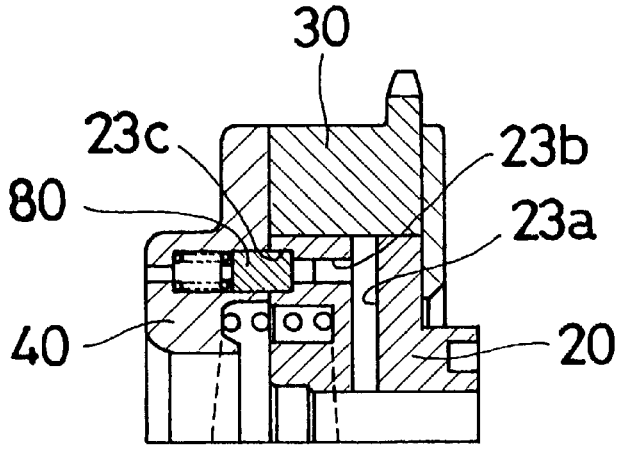
FIG. 9 is a cross-sectional view taken along the section line 9—9 of FIG. 8.
Figure 10:
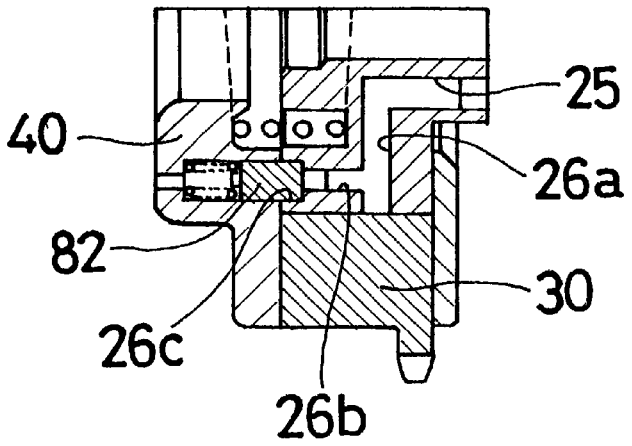
FIG. 10 is a cross-sectional view taken along the section line 10—10 of FIG. 8.

When the relative phase of the inner rotor 20 and the outer rotor 30 is at the relative phase corresponding to the start of the engine as shown in FIGS. 8 through 10, the heads of the second lock pin 80 and the first lock pin 82 are inserted into or positioned in the second restricting groove 23*c* and the first restricting groove 26*c* respectively until operation fluid equal to or greater than a first predetermined pressure is supplied to the advance conduit 11 and to the retard conduit 12 from the oil pump 110 actuated by the engine via the control valve 100 (refer to FIGS. 9 and 10).

Accordingly, the relative rotation of the inner rotor 20 and the outer rotor 30 by the variable torque acting on the cam shaft at the actuation of the intake valve is restricted by the first lock pin 82 and the second lock pin 80 so as not to generate relative rotation vibration, thus preventing the generation of contacting noise between the vane 70 and the projection portion 32 accompanying the rotation vibration.

When the control valve 100 is de-energized and operation fluid pressure equal to or greater than the first predetermined pressure is supplied from the oil pump 110 to the retard angle conduit 12 via the control valve 100 after passage of a predetermined time period from the engine start, the operation fluid is supplied to the first restricting groove 26*c* via the second conduit 25, the sixth conduit 26*a*, and the seventh conduit 26*b*. The first lock pin 82 thus overcomes the biasing force of the spring 83 and moves into the retracting bore 43, and the head of the first lock pin 82 retracts from the first restricting groove 26*c* into the retracting bore 43. Because the advance conduit 11 is in communication with a fluid reservoir (an oil reservoir) 120 via the control valve 100, the head portion of the second lock pin 80 is kept in the second restricting groove 23*c* by the biasing force of the spring 81. Accordingly, the rotation of the inner rotor 20 relative to the outer rotor 30 from the position corresponding to the engine start to the most retarded angle position is allowed.

Figure 15:
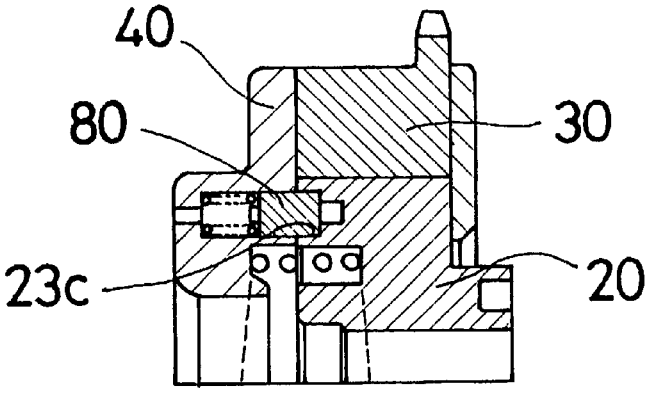
FIG. 15 is a cross-sectional view taken along the section line 15—15 of FIG. 14.
Figure 16:
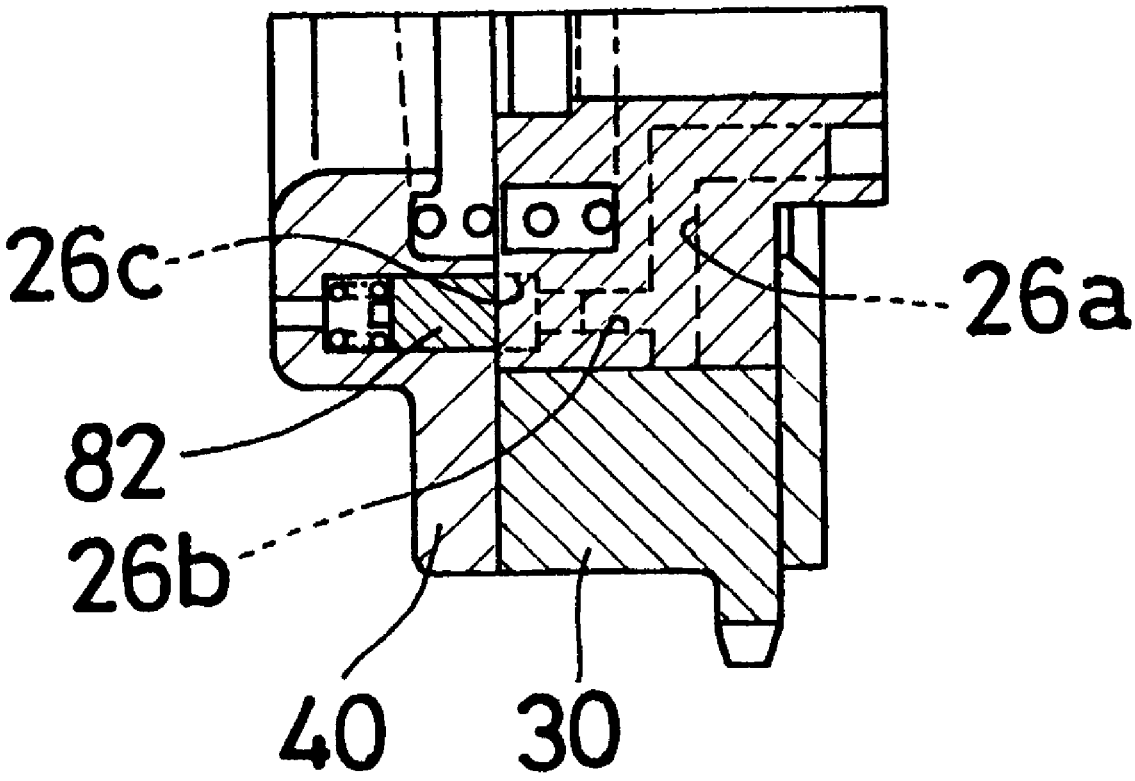
FIG. 16 is a cross-sectional view taken along the section line 16—16 of FIG. 14.

When the pressure of the operation fluid supplied from the oil pump 110 to the retard conduit 12 via the control valve 100 becomes equal to or greater than a second predetermined pressure, wherein the second predetermined pressure is larger than the first predetermined pressure, the operation fluid is supplied from the retard conduit 12 to each retarded angle chamber via the third annular groove 20*a*, the second conduit 25, the third conduit 27, the sixth conduit 26*a*, the seventh conduit 26*b*, and the first restricting groove 26*c* in this condition (in the de-energized condition), and the operation fluid is discharged from each advance chamber R1 to flow to the retarded angle chamber R2 via each first conduit 24, the second restricting groove 23*c*, the fifth conduit 23*b*, the fourth conduit 23*a*, the advance angle conduit 11. The control valve 100, the inner rotor 20 and each vane 70 rotate relative to the outer rotor 30 towards the retarded angle side. The amount of relative rotation towards the retarded angle side (the most retarded angle amount) is restricted by the vane 70 (the one at the top left) contacting the peripheral end surface of the advanced angle side of the projection 32 (shown in FIG. 14) by the rotation of the inner rotor 20 relative to the outer rotor 30 by the predetermined angle θ from the position corresponding to the engine start (shown in FIG. 8) to the retarded angle side. In this case, as shown in FIG. 15, the head portion of the second lock pin 80 is inserted into or positioned in the second restricting groove 23*c*. As shown in FIG. 16, the head portion of the first lock pin 82 is not inserted into the first restricting groove 26*c*, but rather slidably contacts the front side of the inner rotor 20.

Figure 11:
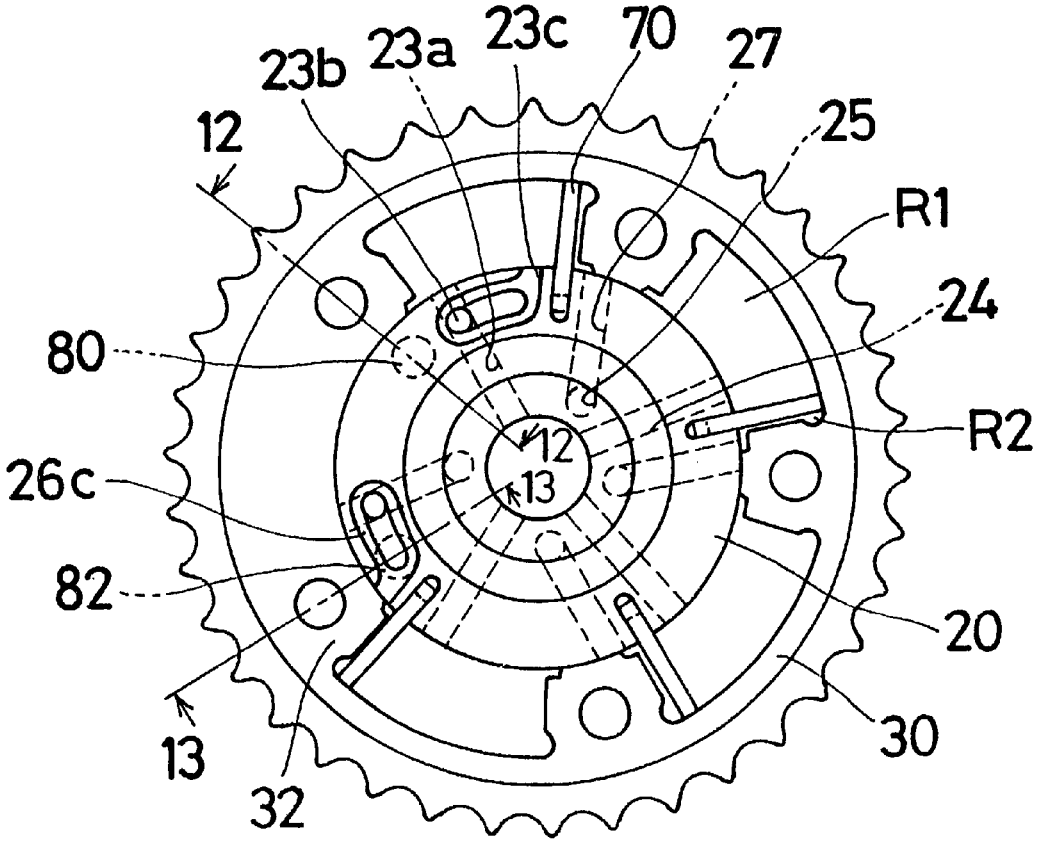
FIG. 11 is a front view illustrating an advanced angle operation condition of the embodiment of the variable valve timing system shown in FIG. 1, with the front plate removed.
Figure 12:
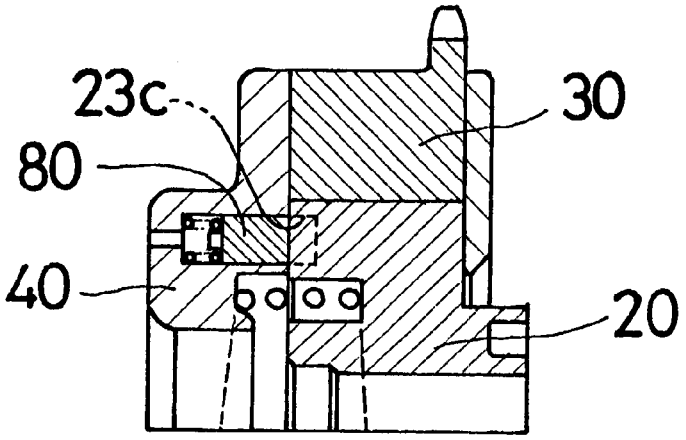
FIG. 12 is a cross-sectional view taken along the section line 12—12 of FIG. 11.
Figure 13:
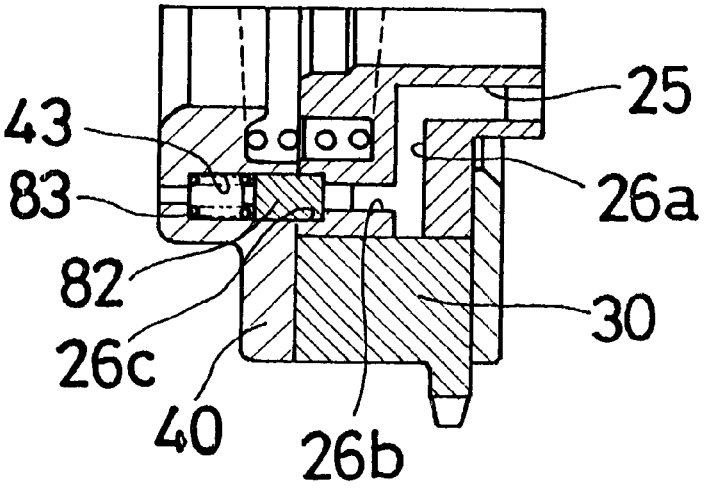
FIG. 13 is a cross-sectional view taken along the section line 13—13 of FIG. 11.
Figure 14:
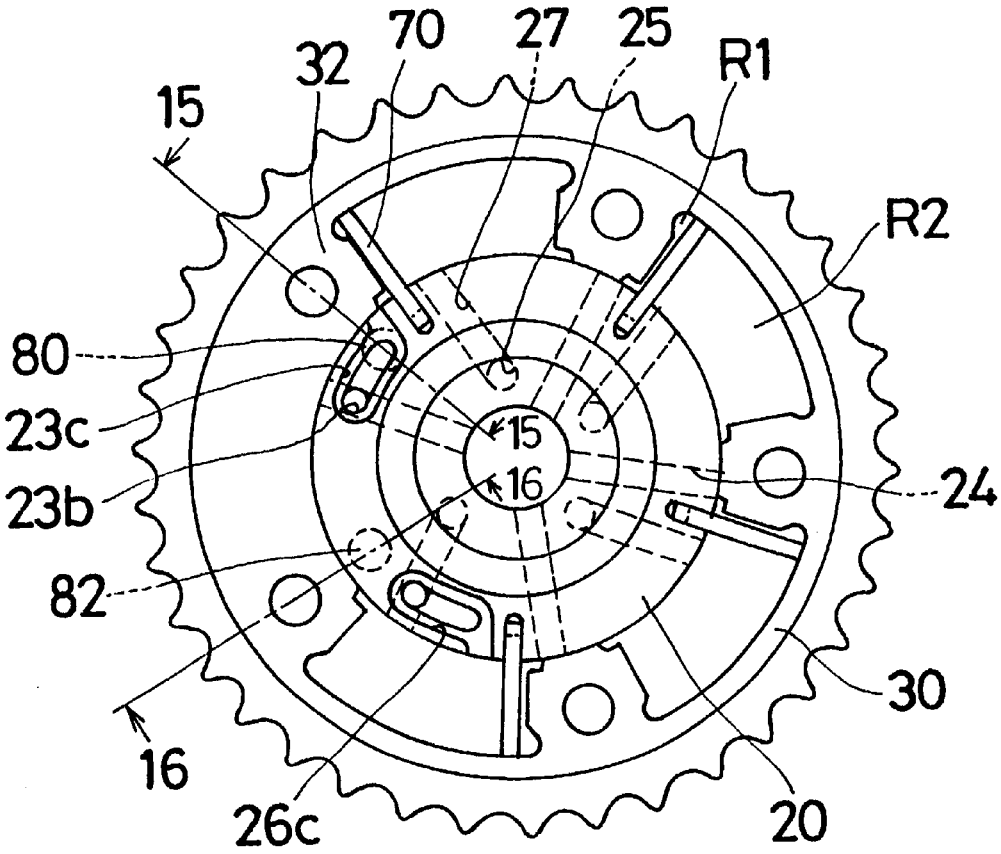
FIG. 14 is a front view illustrating a retarded angle operation condition of the embodiment of the variable valve timing system shown in FIG. 1 with the front plate removed.

When the control valve 100 is energized (the duty ratio of the electric current supplied to the solenoid 103 is determined higher), operation fluid pressure equal to or greater than the second predetermined pressure is supplied to each advanced angle chamber R1 via the advanced angle conduit 11, the first conduit 24, the fourth conduit 23*a*, the fifth conduit 23*b*, and the second restricting groove 23*c*, and the operation fluid is discharged from each retarded angle chamber R2 via the second conduit 25, the sixth conduit 26*a*, the seventh conduit 26*b*, the third conduit 27, the retard conduit 12, and the control valve 100 to flow into the advanced angle chamber R1. Accordingly, the inner rotor 20 and each vane 70 rotate relative to the outer rotor 30 towards the advanced angle side, with the head of the second lock pin 80 being moved out of the second restricting groove 23*c*. The relative rotation amount (the most advanced angle amount) is restricted by the vane 70 (the one at the bottom left) contacting the peripheral end surface of the retarded angle side of the projection 32 as shown in FIG. 11. In this case, the head portion of the first lock pin 82 is inserted into or positioned in the first restricting groove 26*c* by the spring 83 when the first retracting bore 43 is opposite to the first restricting groove 26*c* as shown in FIG. 13. The head portion of the second lock pin 80 is not inserted into or positioned in the second restricting groove 23*c*, but rather slidably contacts the front side of the inner rotor 20 as shown in FIG. 12.

In accordance with the variable valve timing system of the present invention, the timing of opening and closing the intake valve is determined corresponding to the timing of the engine start when the inner rotor 20 and the outer rotor 30 are at the predetermined relative phase in which each vane 70 is positioned in the middle of the fluid pressure chamber R0 and the inner rotor 20 is rotated relative to the outer rotor 30 from the most retarded angle position (FIG. 14) towards the advanced angle side by the predetermined angle θ (FIG. 8). Accordingly, when the vane 70 moves in the range from the position corresponding to the engine start to the most retarded position in which the vane 70 contacts the peripheral end surface of the projection 32 in the advance angle, the most retarded position can be further delayed compared to the opening and closing timing of the valve at engine combustion. By shifting the phase in the foregoing manner from the position corresponding to the engine start to the retarded angle side by controlling the control valve 100 to delay the closing timing of an intake valve (not shown) until the time that the engine combustion has difficulty to start the engine, the volumetric efficiency is improved by the inertia of the intake air to improve the output of the engine at high rotation.

When the engine is stopped, the actuation of the oil pump 110 is stopped to stop the supply of operation fluid to the fluid pressure chamber R0 and the control valve 100 is de-energized. As a result, the advanced angle fluid pressure in the advanced angle chamber R1 and the retarded angle fluid pressure in the retarded angle chamber R2 do not affect the movement of the vane 70. Only the force (until the crankshaft of the engine is completely stopped) towards the retarded angle by the variable torque acting on the cam shaft 10 affects the inner rotor 20 and the cam shaft 10. The relative phase of the inner rotor 20 and the outer rotor 30 at engine stopping is determined in accordance with the relative phase of the inner rotor 20 and the outer rotor 30 immediately before stopping. When the relative phase at stopping of the engine corresponds to the relative phase at the position corresponding to the engine start, the head portion of the first and the second lock pins 82, 80 is inserted into or positioned in the first and the second restricting grooves 26*c*, 23*c* by the springs 84, 81 respectively to lock the relative phase position of the inner rotor 20 and the outer rotor 30.

Figure 5:
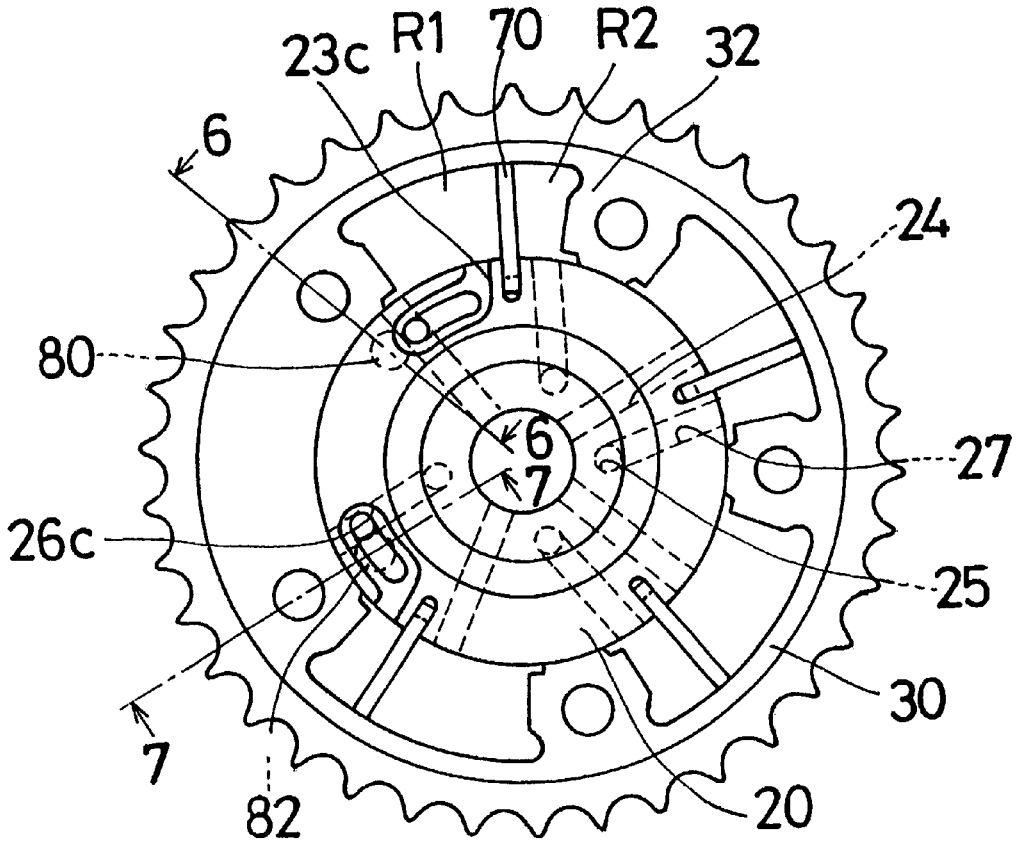
FIG. 5 is a front view of the variable valve timing system shown in FIG. 1 with the front plate removed and in a condition in which the engine is stopped at a further advanced angle side compared to the lock position shown in FIG. 1.
Figure 6:
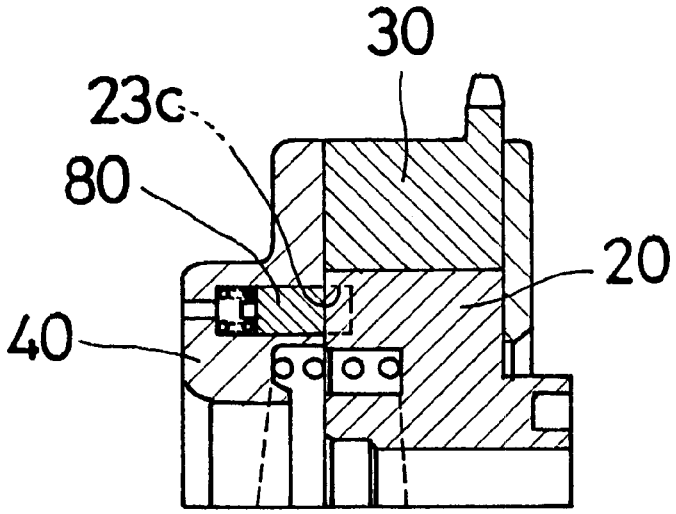
FIG. 6 is a cross-sectional view taken along the section line 6—6 of FIG. 5.
Figure 7:
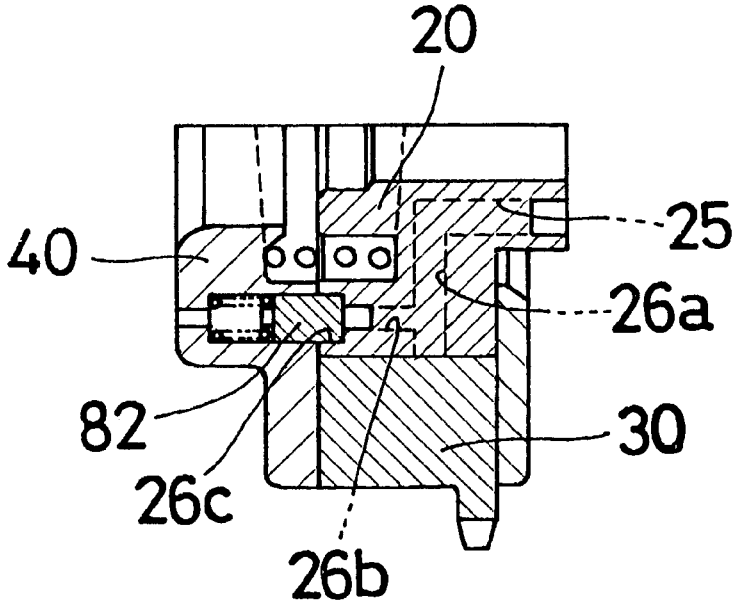
FIG. 7 is a cross-sectional view taken along the section line 7—7 of FIG. 5.

When the relative phase of the inner rotor 20 and the outer rotor 30 at the stop of the engine is positioned at the advanced angle side compared to the position corresponding to the engine start as shown in FIG. 5, the head portion of the second lock pin 80 is not inserted into the second restricting groove 23*c* (FIG. 6) and the head portion of the first lock pin 82 is inserted into or positioned in the first restricting groove 26*c*. Accordingly, relative rotation of the inner rotor 20 and the outer rotor 30 is restricted between the position corresponding to the engine start and the most advanced angle position. When the crankshaft is actuated by the engine starter at the start of the engine under this condition, the inner rotor 20 rotates relative to the outer rotor 30 between the range of the position corresponding to the engine start and the most advanced angle position by the variable torque acting on the cam shaft 10, and the head of the second lock pin 80 is inserted into or positioned in the second restricting groove 23*c* when the relative phase of the inner rotor 20 and the outer rotor 30 is positioned at the position corresponding to the engine start. Consequently, the relative phase of the inner rotor 20 and the outer rotor 30 is locked.

When the relative phase of the inner rotor 20 and the outer rotor 30 at the stop of the engine corresponds to the retarded angle side compared to the position corresponding to the engine start as shown in FIG. 2, the head portion of the second lock pin 80 is inserted into or positioned in the second restricting groove 23*c* (FIG. 3) and the head portion of the first lock pin 82 is not inserted into or positioned in the first restricting groove 26*c*. Accordingly, the relative phase of the inner rotor 20 and the outer rotor 30 is restricted in the range between the position corresponding to the engine start and the most retarded angle position. When the crankshaft is actuated by the engine starter while starting the engine under this condition, the inner rotor 20 rotates relative to the outer rotor 30 between the position corresponding to the engine start and the most retarded angle position by the variable torque acting on the cam shaft 10 and the head portion of the first lock pin 82 is inserted into or positioned in the first restricting groove 26*c* when the relative position of the inner rotor 20 and the outer rotor 30 corresponds to the position corresponding to the engine start. As a result, the relative phase of the inner rotor 20 and the outer rotor 30 is locked. Because it takes a certain period to raise the pressure of the operation fluid supplied from the oil pump 110 to be equal to or greater than the first predetermined pressure after the engine start, the first and the second lock pins 82, 80 are inserted into or positioned in the first and the second restricting grooves 26*c*, 23*c* by the first and the second springs 83, 81 respectively for the aforementioned actuation by the engine starter.

In due course, unnecessary relative rotation between the rotation member including the cam shaft 10, the inner rotor 20, and each vane 70 and the rotation transmitting member including the outer rotor 30, the front plate 40, and the rear plate 50 is substantially completely restricted. This prevents the generation of noise by the vane 70 accompanied by unnecessary relative rotation between the rotation member and the rotation transmitting member.

According to the variable valve timing system of the present invention, the volumetric efficiency can be improved during high rotation of the engine while preventing noise generation associated with contact between the vane 70 and the peripheral end surface of the projection 32 at the start of the engine, while also improving the smooth start of the engine.

Although the embodiment of the present invention described above is discussed in the context of being applied to a variable valve timing system assembled to the cam shaft for the air intake valve, the present invention also has useful application to a variable valve timing system assembled to the cam shaft for exhausting air in the same manner.

As described above, the restriction release of the second lock pin 80 is conducted by the operation fluid flowing into the advanced angle chamber and the restriction release of the first lock pin 82 is achieved by the operation fluid flowing into the retarded angle chamber. However, the operation fluid for restriction release of the first and second lock pins 82, 80 may be supplied through a separate conduit different from the conduits in communication with the advanced angle chamber and the retarded angle chamber.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A variable valve timing system for an internal combustion engine comprising:

a rotation member rotating with one of a crankshaft and a cam shaft;

a rotation transmitting member rotatably supported relative to the rotation member within a predetermined range and rotating with the other of the crankshaft and the cam shaft;

a vane provided on the rotation member;

a fluid pressure chamber formed between the rotation member and the rotation transmitting member and divided into an advanced angle chamber and a retarded angle chamber by the vane;

the rotation member and the rotation transmitting member being relatively rotated by fluid pressure applied to the advanced angle chamber and the retarded angle chamber to change opening and closing timing of a valve to be actuated by the cam shaft by changing a rotation phase of the cam shaft relative to the rotation phase of the crankshaft;

first relative rotation restricting means for restricting relative rotation between the rotation member and the rotation transmitting member from a most advanced angle position in which a volume of the retarded angle chamber is a minimum to a most retarded angle position in which the volume of the advanced angle chamber is the minimum by the vane at a position corresponding to engine start where the vane is positioned at approximately a middle of the fluid pressure chamber and releasing a first restriction by the fluid pressure applied to the retarded angle chamber; and second relative rotation restricting means for restricting relative rotation between the rotation member and the rotation transmitting member from the most retarded angle position to the most advanced angle position at the position corresponding to engine start and releasing a second restriction by the fluid pressure applied to the advanced angle chamber.

2. The variable valve timing system according to claim 1, wherein the first relative rotation restricting means includes a first restricting member biased by a first spring and accommodated in one of the rotation member and the rotation transmitting member, and a first restricting groove formed on the other of rotation member and the rotation transmitting member to allow relative rotation between the rotation member and the rotation transmitting member from the position corresponding to the engine start to the most advanced angle position by virtue of the first restricting member being positioned in first restricting groove, and to restrict relative rotation between the rotation member and the rotation transmitting member from the position corresponding to the engine start to the most retarded angle position;

the second relative rotation restricting means including a second restricting member biased by a second spring and accommodated in one of the rotation member and the rotation transmitting member, and a second restricting groove formed on the other of the rotation member and the rotation transmitting member to restrict relative rotation between the rotation member and the rotation transmitting member from the position corresponding to the engine start to the most advanced angle position by virtue of the second restricting member being positioned in second restricting groove, and to allow relative rotation between the rotation member and the rotation transmitting member from the position corresponding to the engine start to the most retarded angle position.

3. The variable valve timing system according to claim 2, including a biasing member always biasing the rotation member relative to the rotation transmitting member towards the advanced angle side with a predetermined biasing force.

4. A variable valve timing system for an internal combustion engine comprising:

a rotation member rotating with one of a crankshaft and a cam shaft;

a rotation transmitting member rotatably supported relative to the rotation member within a predetermined range and rotating with the other of the crankshaft and the cam shaft;

a vane provided on the rotation member;

a fluid pressure chamber formed between the rotation member and the rotation transmitting member and divided by the vane into an advanced angle chamber and a retarded angle chamber;

the rotation member and the rotation transmitting member being relatively rotated by fluid pressure in the advanced angle chamber and the retarded angle chamber, with a rotation phase of the cam shaft changing relative to the rotation phase of the crankshaft to change opening and closing timing of a valve;

a first relative rotation restricting member restricting relative rotation between the rotation member and the rotation transmitting member from a most advanced angle position in which a volume of the retarded angle chamber is a minimum to a most retarded angle position in which the volume of the advanced angle chamber is a minimum at a position corresponding to the engine start at which the vane is positioned at approximately a middle of the fluid pressure chamber and releasing a first restriction by the fluid pressure greater than a first predetermined pressure after the engine start; and a second relative rotation restricting member restricting relative rotation between the rotation member and the rotation transmitting member from the most retarded angle position to the most advanced angle position and releasing a second restriction by the fluid pressure at greater than a second predetermined pressure after the engine start.

5. The variable valve timing system according to claim 4, wherein the first relative rotation restricting member includes a first restricting member biased by a first spring and accommodated in one of the rotation member and the rotation transmitting member, and a first restricting groove formed on the other of rotation member and the rotation transmitting member to allow relative rotation between the rotation member and the rotation transmitting member from the position corresponding to the engine start to the most advanced angle position by virtue of the first restricting member being positioned in first restricting groove, and to restrict relative rotation between the rotation member and the rotation transmitting member from the position corresponding to the engine start to the most retarded angle position.

6. The variable valve timing system according to claim 4, wherein the second relative rotation restricting member includes a restricting member biased by a spring and accommodated in one of the rotation member and the rotation transmitting member, and a restricting groove formed on the other of the rotation member and the rotation transmitting member to restrict relative rotation between the rotation member and the rotation transmitting member from the position corresponding to the engine start to the most advanced angle position by virtue of the second restricting member being positioned in second restricting groove, and to allow relative rotation between the rotation member and the rotation transmitting member from the position corresponding to the engine start to the most retarded angle position.

7. The variable valve timing system according to claim 4, including a biasing member always biasing the rotation member relative to the rotation transmitting member in a direction towards the most advanced angle position with a predetermined biasing force.

8. A variable valve timing system for an internal combustion engine comprising:

a rotation member adapted to rotate together with one of a crankshaft and a cam shaft;

a rotation transmitting member supported with respect to the rotation member for relative rotation between the rotation member and the rotation transmitting member within a predetermined range;

a vane provided on the rotation member;

a fluid pressure chamber formed between the rotation member and the rotation transmitting member and divided by the vane into an advanced angle chamber and a retarded angle chamber;

the rotation member and the rotation transmitting member being relatively rotated by fluid pressure applied to the advanced angle chamber and the retarded angle chamber to change opening and closing timing of a valve to be actuated by the cam shaft by changing a rotation phase of the cam shaft relative to the rotation phase of the crankshaft;

a first bore provided in one of the rotation member and the rotation transmitting member, a first groove provided in the other of the rotation member and the rotation transmitting member, and a first pin slidably received in the first bore for sliding movement between one position in which a portion of the first pin is received in the first groove to restrict relative rotation between the rotation member and the rotation transmitting member to an engine start position at which the vane is positioned at approximately a middle of the fluid pressure chamber and a second position at which the portion of the first pin is moved out of the first groove by fluid pressure to restrict relative rotation between the rotation member and the rotation transmitting member from a most advanced angle position in which a volume of the retarded angle chamber is a minimum to the engine start position.

9. The variable valve timing system according to claim 8, including a second bore provided in one of the rotation member and the rotation transmitting member, a second groove provided in the other of the rotation member and the rotation transmitting member, and a second pin slidably received in the second bore for sliding movement between one position in which a portion of the second pin is received in the second groove to restrict relative rotation between the rotation member and the rotation transmitting member to the engine start position and a second position at which the portion of the second pin is moved out of the second groove by fluid pressure to restrict relative rotation between the rotation member and the rotation transmitting member from a most retarded angle position in which a volume of the advanced angle chamber is a minimum to the engine start position.

10. The variable valve timing system according to claim 9, wherein the first pin is biased to the one position by a first spring and the second pin is biased to the one position by a second spring.

11. The variable valve timing system according to claim 8, wherein the first pin is biased to the one position by a first spring.

12. The variable valve timing system according to claim 8, including a biasing member always biasing the rotation member relative to the rotation transmitting member towards the most advanced angle position.

13. The variable valve timing system according to claim 8, including a plurality of projection portions extending radially inwardly from the rotation transmitting member and slidably engaging the rotation member, the vane being positioned between two adjacent projection portions.

14. The variable valve timing system according to claim 8, including a control valve fluidly communicated with the advanced angle chamber and the retarded angle chamber for controlling the fluid pressure to the advanced angle chamber and a retarded angle chamber.

* * * * *